United States Patent [19]

Buryan et al.

[11] Patent Number: 5,060,433

[45] Date of Patent: Oct. 29, 1991

[54] FACADE FACING ELEMENT

[75] Inventors: Rudolf Buryan, Johannessiedlung 1, A2170 Poysdorf; Konrad Berger, Gablitz, both of Austria

[73] Assignees: Universale-Bau AG, Vienna; Rudolf Buryan, Poysdorf, both of Austria

[21] Appl. No.: 405,621

[22] Filed: Sep. 11, 1989

[30] Foreign Application Priority Data

Sep. 16, 1988 [AT] Austria ..... 2276/88

[51] Int. Cl.[5] ..... E04B 2/88

[52] U.S. Cl. ..... 52/235; 52/513

[58] Field of Search ..... 52/235, 513, 391, 511, 52/378, 486, 484, 434

[56] References Cited

U.S. PATENT DOCUMENTS

| | | | |
|---|---|---|---|
| 3,071,827 | 1/1963 | Van Buren, Jr. | 52/511 |
| 3,299,601 | 1/1967 | Chiville | 52/391 |
| 3,476,912 | 11/1969 | Garrison | 52/235 |
| 3,640,043 | 2/1972 | Querfeld | 52/235 |
| 3,834,099 | 9/1974 | Haeussler | 52/235 |

*Primary Examiner*—Richard E. Chilcot, Jr.
*Assistant Examiner*—Michele A. Van Patten
*Attorney, Agent, or Firm*—Herbert Dubno

[57] ABSTRACT

Natural stone slabs are connected to a concrete slab by elastic hook and through the intermediary of an elastic layer to allow slight mobility of stone slabs relative to the concrete slab in a facade-facing element.

7 Claims, 4 Drawing Sheets

FACADE FACING ELEMENT

FIELD OF THE INVENTION

Our present invention relates to a facade facing element for building structures and, more particularly, to a facade facing element having a concrete slab and provided on one side with an esthetic structure and on the opposite side with means for affixing that element to the building structure.

BACKGROUND OF THE INVENTION

Building facades of natural stone slabs which are quarried and shaped by stone masons are complicated to attach to building structures. In particular, they require expensive fastening and suspending structures to enable them to be supported on the building structure and complex systems for mounting them so that gaps between adjacent slabs are maintained with precision as is required on esthetic grounds.

It has been proposed heretofore to face such structures with large-format prefabricated plates of reinforced concrete which can be provided in a variety of configurations.

Such concrete slabs can be fabricated in a simple manner and the technique of fastening them to the building structure, e.g. on existing walls or building frameworks, is well developed. The suspension and attachment elements may be embedded in the concrete upon casting.

It is also known to provide so-called composite elements utilizing steel-reinforced steel slabs which themselves ar provided with facings, e.g. of ceramic plates. In earlier systems, the connection of the facing plate to the reinforced concrete slab has not been satisfactory since the connection was neither completely reliable nor capable of withstanding all of the stresses to which the slabs can be subject. Specifically, it could not always be ensured that the fixing member would not come loose from the supporting concrete slab.

Because of the poor attachment of the fixing layer and the inability to insure that the attachment would withstand the thermal, weather, wind and other stresses to which the attachment is subject, composite elements of this latter type have not been used as widely as might otherwise be the case.

OBJECTS OF THE INVENTION

It is, therefore, the principal object of the present invention to provide an improved facade-facing element which will be free from the drawbacks of the earlier systems enumerated above.

Another object of this invention is to provide a building element of the type described in which the danger of separation of the facing plate from the reinforcing concrete slab is greatly reduced or eliminated.

It is a further object of this invention to provide an improved method of making a facade-facing element according to the invention.

SUMMARY OF THE INVENTION

These objects and others which will become apparent hereinafter are attained, in accordance with the present invention in a facade-facing element which comprises a concrete slab provided on one of its broad sides with the suspension and attachment means for hanging the facade-facing element on a building structure and provided on its opposite face with a stone slab, specifically a natural-stone or quarried slab. The drawbacks of earlier facade-facing elements are eliminated by providing an elastic fastening means between the concrete slab and the stone slab or slabs.

Because of this elastic connection, the stone slab and concrete slab can move relatively to one another slightly so that layers of the stone slab from the concrete slab is no longer possible in spite of the differences in thermal expansion coefficients and other physical properties of the two types of slabs. The elastic connection of the elastic concrete slab and the stone slab or slabs can be accomplished in various ways. In a preferred embodiment of the invention, the elastic fastening element for connecting the concrete slab and stone slab or slabs can include hooks, pins, springs or the like which can be received in respective recesses in both the concrete slab or stone slab or slabs.

The elastic fastening elements can be formed entirely of elastically deformable material. However, in a preferred embodiment of the invention, the fastening elements have a load supporting part, e.g. a core of steel, which is coated at least in the region in which the fastening elements are received in the holes in the concrete slab and/or the stone slab or slabs, with an elastic covering.

To provide further mobility between the stone slab or slabs and the supporting concrete slab according to another feature of the invention, a preferably elastic separating layer is provided between the concrete slab and the stone slab or slabs.

According to the invention, therefore, a facade-facing element can comprise:

a concrete slab formed with a pair of opposite broad sides;

attachment means affixed to the concrete slab on one of the sides for securing the facade member to the building structure;

stone slab means including at least one stone slab juxtaposed with another of the sides of the concrete slab and substantially coextensive therewith for covering substantially all of the other side of the concrete slab; and elastic fastening means interconnecting the stone slab means and the concrete slab resiliently for maintaining the stone slab means nondetachably on the concrete slab while permitting slight relative movement of the stone slab and the concrete slab.

In its method aspect, the invention provides a method of fabricating the element in a simple manner by first inserting the stone slabs into a concrete mold or framework so that the fastening elements project upwardly.

The separating layer is then applied to the natural stone plates so that these fastening elements project through the intermediate layer and on this intermediate layer, the concrete slab is formed, e.g. by pouring concrete.

BRIEF DESCRIPTION OF THE DRAWING

The above and other objects, features and advantages of my invention will become more readily apparent from the following description, reference being made to the accompanying highly diagramatic drawing in which.

SPECIFIC DESCRIPTION

Figure 1:
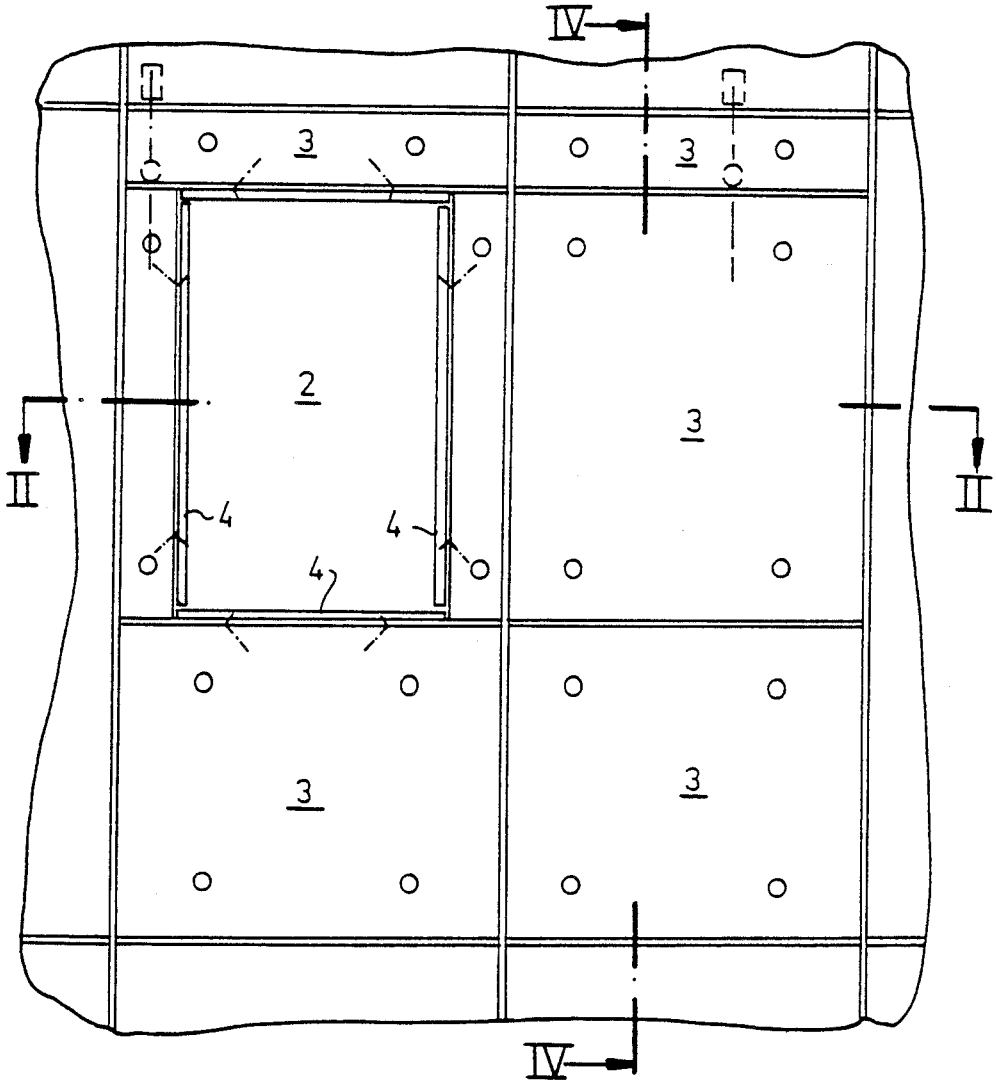
FIG. 1 is an elevational view of a facade-facing element according to the invention.
Figure 2:
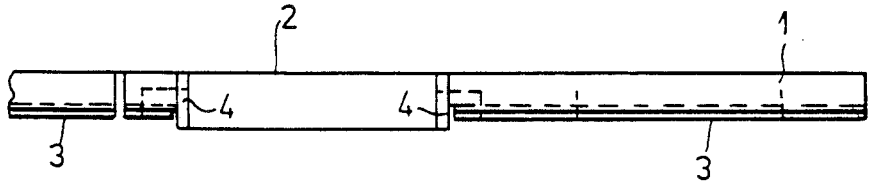
FIG. 2 is a cross sectional view taken along the line II—II of FIG. 1.

The facade-facing element shown in FIGS. 1 through 4 comprises a load-bearing concrete slab 1 which can be provided with steel reinforcements and which can have a window 2. The rectangular slab 1 has secured thereto natural stone slabs 3 and 4. The stone slabs 3 lie parallel to the concrete slab 1. In the region of the window 2, the edges of the slab bounding the window are covered by natural stone quarried slabs 4 which thus lie at right angles to the plane of the concrete slab 1 and the rectangular array of natural stone slabs 3.

Figure 3:
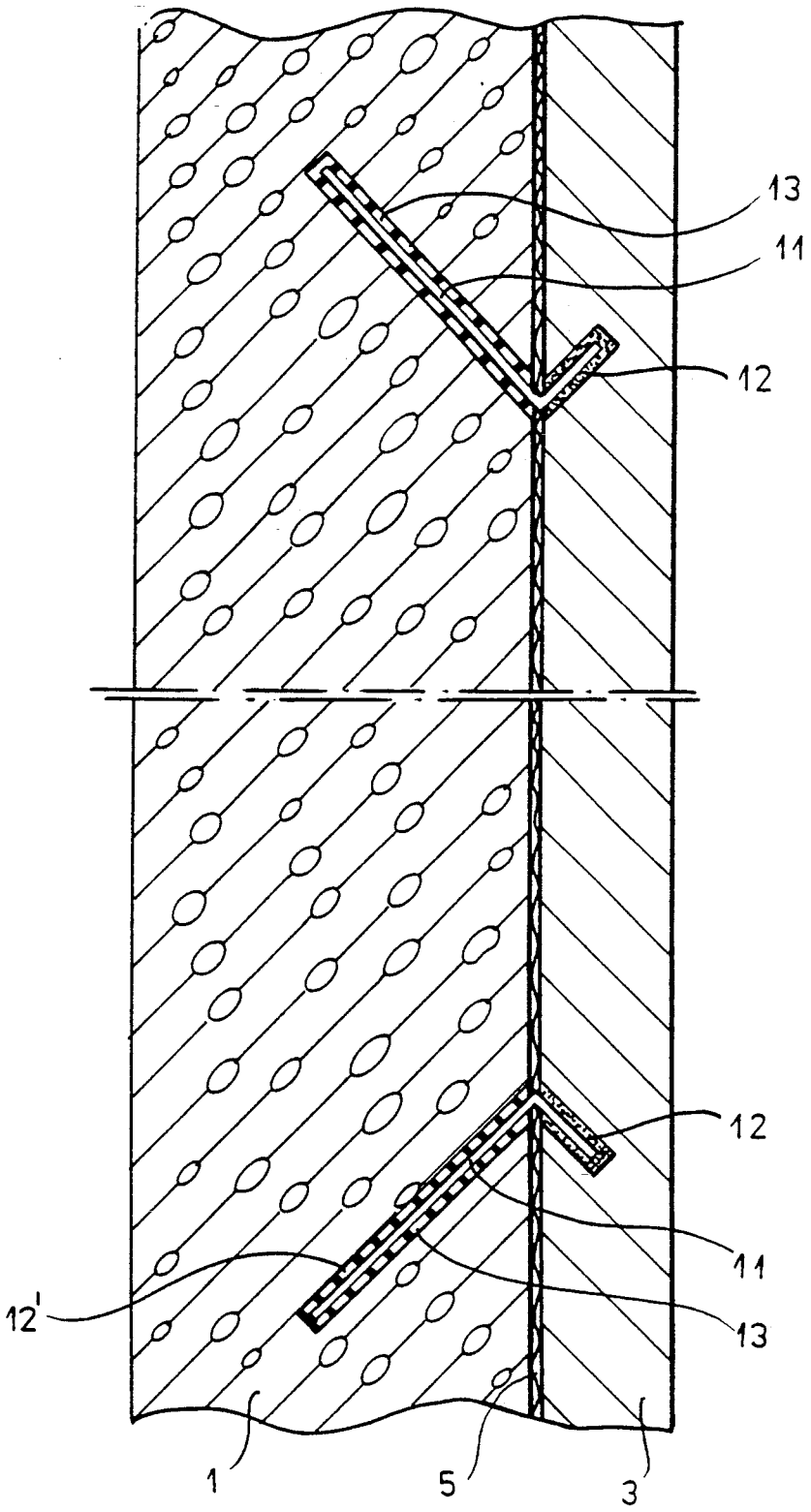
FIG. 3 is a partial section through the element of FIGS. 1 and 2, drawn to a substantially larger scale than that of FIGS. 1 and 2.

FIG. 3 shows the facade-facing element in partial section and it is apparent from this view that between the concrete slab 1 and the stone slabs 3, a separating layer 5 is provided. The separating layer 5 is advantageously formed as an elastically deformable plastic foil. From FIGS. 5*b* and 5*c* it will be apparent that this foil can be embossed or deformed so as to have bulges 5*a* spaced apart thereon to promote drainage.

The natural stone slabs 3 are connected to the concrete slab 1 by hook-like stirrups 11. The stirrups 11 are composed on steel and are provided at 13 with elastic coverings, e.g. of rubber, where these fastening elements are anchored in the concrete slab.

In FIG. 3, the holes receiving the elements 11 are represented at 12 in the natural stone slabs 13 and at 12' in the concrete element. The latter holes may be formed by casting the concrete around the elements 11.

Because of the elasticity of the intermediate layer 5 of the one hand and the elastic coatings 13 on the other hand, the natural stone plates can be slightly movable relative to the concrete slab 1. The transversely positioned facing plates 4 can be attached to the concrete slab 1 in a similar manner.

Figure 4:
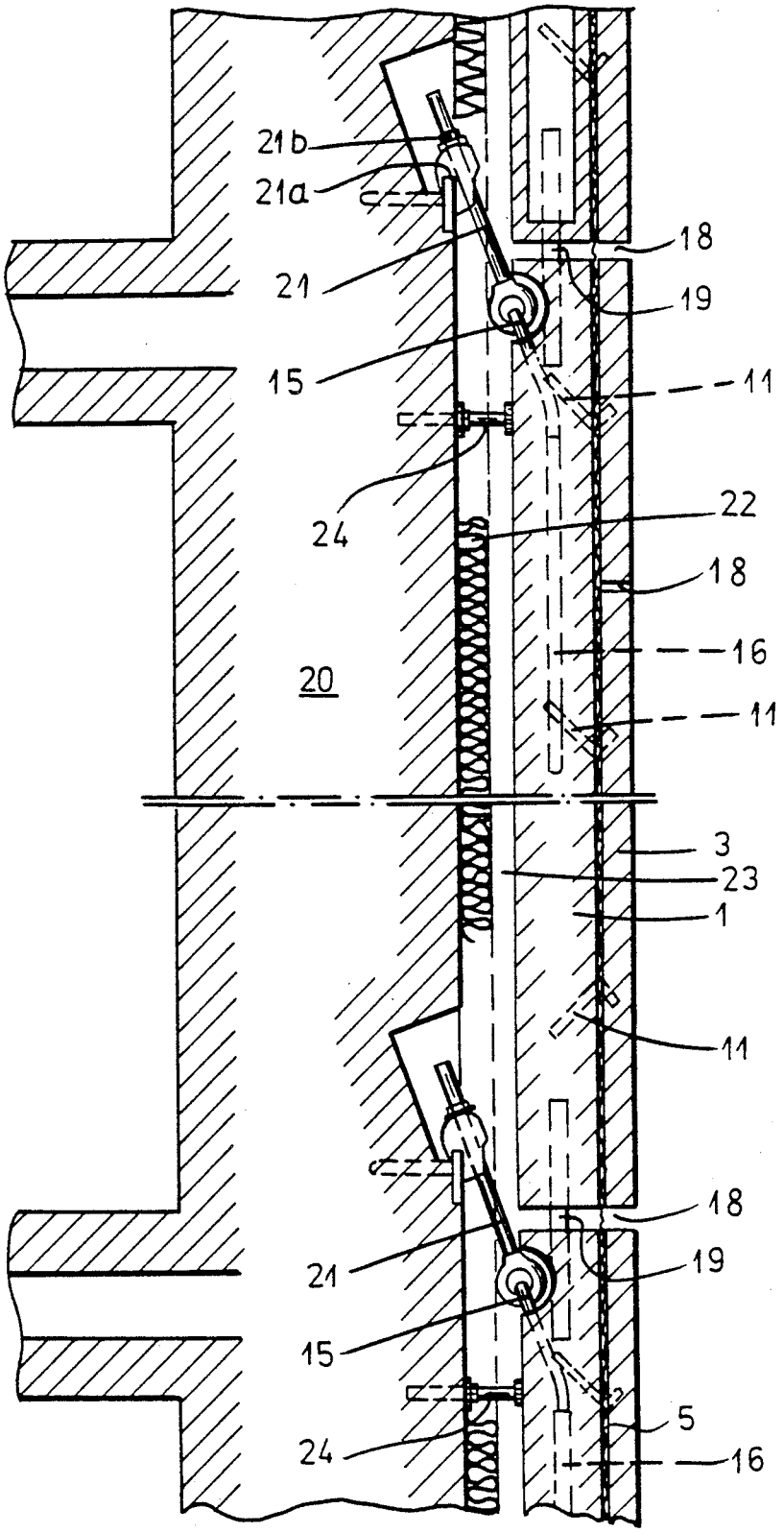
FIG. 4 is a section taken along the line IV—IV of FIG. 1 also drawn to a substantially greater scale.

FIG. 4 shows the facade-facing element of the invention mounted upon a building structure.

In this FIG., the wall 20 of the building structure is shown to be provided with attachment bolts 21 which can be threaded, can pass through swivels 21*a* anchored in the concrete of the wall and can be adjustable in these swivels by nuts 21*b*. the bolts 21 are swingably mounted in eyes 15 affixed to anchors 16 embedded in the concrete of the slab 1, e.g. as tension members or reinforcements so that the facade-facing elements can thereby be suspended from the structure.

The outer surface of the wall 20 is provided with a heat lagging or thermal insulating layer 22 and between this insulating layer 22 and the facade-facing element, a space 23 can be provided.

To maintain the spacing of the facade-facing element from the wall 20, additional spacers 24 can be provided which are adjustable.

The edges of the concrete slab of adjacent facade-facing elements can be provided with bores in which alignment pins 19 are received. These pins 19 insure that the front faces of the facade-facing elements will lie in a common plane.

Between the facade-facing elements, gaps are provided to permit ventilation of the space 23 and a circulation of air behind the facade.

Because the elastic separating layer 5 and the elastic coating 13 on the fastening stirrups 11 permit a slight mobility of each of the natural stone slabs 3 on and relative to the concrete slab 1, thermal movements do not detrimentally effect the attachment of the stone slabs on the concrete slab. The fastening stirrups themselves maybe made of a noncorroding material such as stainless steel.

The knubby thermoplastic foil of the intermediate layer 5 provides a highly effective drainage layer between the natural stone slabs and the reinforced concrete slab 1.

Figure 5A:
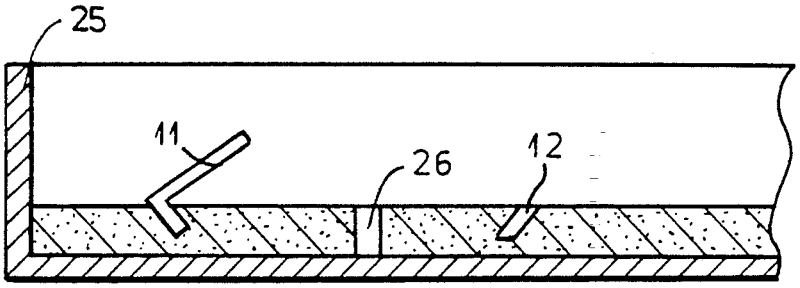
FIGS. 5*a*–5*c* are views partially in cross section, illustrating successive steps in the method of the invention.
Figure 5B:
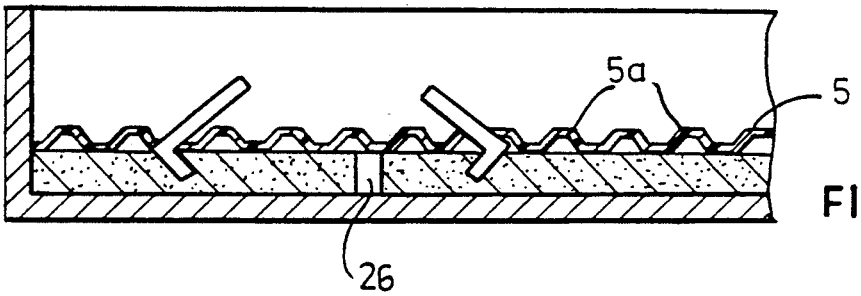
Figure 5C:
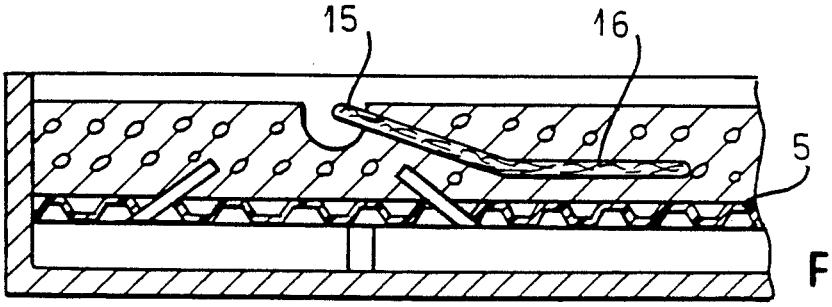

As can be seen from FIG. 5*a*, the natural stone slabs provided with the holes 2 in which the stirrups 11 are inserted can be placed in a concrete mold or framework 25 and separated by separators which can be later removed if desired (FIG. 5*a*).

The plastic foil layer 5 is then applied (FIG. 5*b*) and the stirrup 11 with their coatings 13 can project through this layer.

The concrete is then cast onto the layer 5 (FIG. 5*c*) and the attachment elements 15, 16, for example, embedded in the concrete. Upon setting of the concrete, the facade-facing slab can be removed from the mold.

The elastic connection between the stone slabs and the concrete slab can be effected also by making the fastening stirrups intrinsically elastic. The fastening elements need not be hook shaped and can be simply straight pins or pins which are slightly inclined according to the invention.

What is claimed is:

1. A building structure comprising:

a building wall; and a facade member for facing a facade and mounted on said wall, said facade member including:

as concrete slab formed with a pair of opposite broad sides;

attachment means affixed to said concrete slab on one of said sides for securing said facade member to said wall with said one of said sides spaced therefrom;

stone slab means including at least one stone slab juxtaposed with another of said sides of said concrete slab and substantially coextensive therewith for covering substantially all of said other side of said concrete slab;

elastic fastening means interconnecting said stone slab means and said concrete slab resiliently for maintaining said stone slab means nondetachably on said concrete slab while permitting slight relative movement of said stone slab and said concrete slab over an entire area of said other side; and an elastic separating layer interposed between said stone slab means and said other side of said concrete slab, said elastic separating layer formed with drainage passages for draining a space between said stone slab and said elastic separating layer.

2. The building structure defined in claim 1 wherein said stone slab means includes at least one natural-stone slab.

3. The building structure defined in claim 2 wherein said stone slab means includes a rectangular array of a plurality of natural-stone slabs having gaps of uniform width between them.

4. The building structure defined in claim 3 wherein said array frames a window in said concrete slab.

5. The building structure defined in claim 1 wherein said elastic fastening means includes a plurality of elastic elements each received in holes in both said concrete slab and at least one stone slab.

6. The building structure defined in claim 5 wherein said elastic elements are hooks, pins or springs.

7. The building structure defined in claim 5 wherein said elements comprise load-supporting members having coatings of elastic material at least in regions in which said load-supporting members are received in said holes.

* * * * *